US012312928B2

(12) United States Patent
Bull et al.

(10) Patent No.: US 12,312,928 B2
(45) Date of Patent: May 27, 2025

(54) WELLBORE SERVICES SYSTEM WITH ANYTIME ACCESS FOR PUMP MAINTENANCE

(71) Applicant: Halliburton Energy Services, Inc., Houston, TX (US)

(72) Inventors: Brad Robert Bull, Duncan, OK (US); Gero Testa, Duncan, OK (US); Shaun Kyle Pyka, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 18/205,309

(22) Filed: Jun. 2, 2023

(65) Prior Publication Data

US 2024/0401452 A1 Dec. 5, 2024

(51) Int. Cl.
*E21B 43/26* (2006.01)
*E21B 41/00* (2006.01)

(52) U.S. Cl.
CPC ..... *E21B 43/2607* (2020.05); *E21B 41/0021* (2013.01)

(58) Field of Classification Search
CPC ..... E21B 43/2607; E21B 41/0021
See application file for complete search history.

(56) References Cited

U.S. PATENT DOCUMENTS 8,851,186 B2 10/2014 Shampine et al.
10,741,158 B1 * 8/2020 Aune ..... E04B 1/8404
11,041,579 B2 6/2021 Lopez et al.
11,242,950 B2 2/2022 Johnson et al.
11,339,633 B1 5/2022 Bull et al.
11,396,799 B2 7/2022 Johnson et al.
11,585,197 B2 2/2023 Mazrooee et al.
11,867,023 B2 1/2024 Beason et al.
11,867,043 B1 1/2024 Adams et al.
2014/0290768 A1 10/2014 Randle et al.
2016/0208592 A1 * 7/2016 Oehring ..... F04D 29/664
2021/0278176 A1 * 9/2021 Merritt, II ..... F41H 5/013
2022/0372858 A1 11/2022 Scott et al.
2023/0083234 A1 3/2023 Cook et al.
2023/0279758 A1 9/2023 Bull et al.
2023/0279759 A1 9/2023 Bull et al.
2023/0392478 A1 * 12/2023 Han ..... E21B 41/0021
2024/0026765 A1 1/2024 Cook et al.
2024/0410263 A1 * 12/2024 Barron ..... F41H 5/013

OTHER PUBLICATIONS

E-Filing Acknowledgment, Specification and Drawings for U.S. Appl. No. 18/958,190, entitled "Improved Pump Maintenance for Split Flow Wellbore Services System," filed Nov. 25, 2024, 87 pages.

* cited by examiner

*Primary Examiner* — Robert E Fuller
(74) *Attorney, Agent, or Firm* — Conley Rose, P.C.; Rodney B. Carroll

(57) ABSTRACT

Disclosed embodiments include systems and methods for providing maintenance to a pump of a pumping unit in situ within a red zone of a pressurized wellbore services system. Ballistic barriers may be disposed between the pumping unit and the pressurized wellbore services manifold, and the pump may be remotely isolated from fluid communication with the wellbore services manifold and depressurized. Additionally, a secondary barrier, for example on a shielded work platform, may further protect workers, allowing for safe and efficient maintenance of the pump.

20 Claims, 7 Drawing Sheets

WELLBORE SERVICES SYSTEM WITH ANYTIME ACCESS FOR PUMP MAINTENANCE

FIELD

This disclosure relates generally to the field of pumping. More particularly, this disclosure relates to the field of pumping units. Still more particularly, this disclosure relates to a system allowing maintenance access to the pumps of pumping units in situ when connected to a pressurized manifold of a wellbore services system.

BACKGROUND

Conventional pumping units, such as those utilized for wellbore operations (e.g., for hydraulic fracking) typically are not serviced while the pump of the pumping unit is disposed in a "red zone" of pressurized wellbore services equipment. For example, a red zone may typically be a defined distance adjacent pressurized equipment. Accordingly, for maintenance to be performed, either the pumping unit as a whole may typically be removed from the red zone, or the pump in question may be removed from the red zone. Either of these approaches can be a time-consuming operation, as the job must typically be halted for the time taken to rig down and move the unit. Furthermore, the delays inherent in such a system can negatively impact pumping efficiency of the wellbore services system. Thus, there is a need for improved techniques for safely performing maintenance on a pump of a pumping unit, for example to significantly reduce or eliminate job downtime due to pump maintenance.

BRIEF DESCRIPTION OF THE DRAWINGS

Embodiments of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

As noted above, there is a need for improved techniques for safely performing maintenance on a pump of a pumping unit, for example to reduce downtime of the pump during maintenance. As disclosed herein, the use of shielding, in conjunction with remote isolation and de-pressurization of the pump, may allow for maintenance to be safely performed on the pump, for example on a fluid end of the pump, without the need to move the pump out of the red zone and/or while the wellbore services manifold trailer is pressurized (for example by other active pumps). Before discussing the specifics of such systems and methods for improved (e.g. in situ) maintenance in detail, exemplary pumping units, pumps, and wellbore services systems, of the sort that can be used in this system, will now be set forth.

Figure 1:
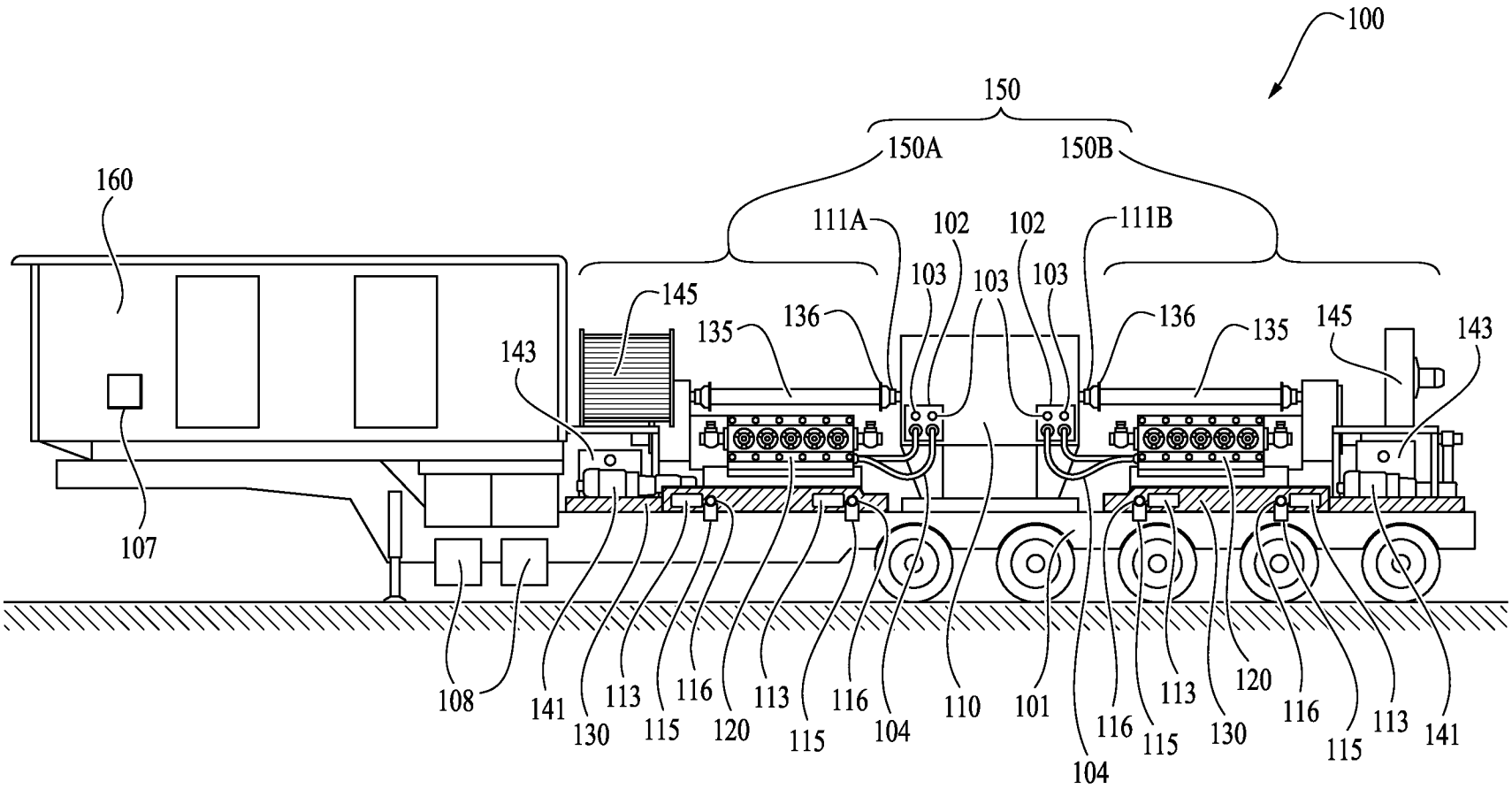
FIG. 1 is a schematic of an exemplary pumping unit, according to embodiments of this disclosure.

FIG. 1 illustrates schematically an exemplary pumping unit 100. While the specific exemplary pumping unit 100 shown in FIG. 1 is configured for a modular approach (allowing modular pump removal and replacement), it should be understood that the maintenance system described herein can be used with various pumping units, whether modular or not. The pumping unit 100 of FIG. 1 can comprise a base structure 101; an electric motor 110 mounted on the base structure 101; and one or more pump modules 150. As depicted via brackets, in the embodiment of FIG. 1, the one or more pump modules 150 include two pump modules 150, comprising first pump module 150A and second pump module 150B. Each of the one or more pump modules 150 comprises a pump 120 and a pump module structure 130. The one or more pump modules 150 are configured to be removably mounted on the base structure 101 and driven by the electric motor 110.

The pumping unit 100 can further comprise at least one connector panel 102 comprising connectors 103 for electrical cables and/or hoses 104 from the one or more pump modules 150, wherein the electrical cables and/or hoses 104 are configured for supplying fluids, electric power, and/or control signals to the one or more pump modules 150, and/or to receive sensor feedback from the one or more pump modules 150. One or more of the connectors/receptacles 103 can be configured for providing/receiving electrical power to the connector panel 102.

The base structure 101 can comprise a truck, a trailer, or a skid. The electric motor 110, an electric motor drive 160 (which can include) an auxiliary electric power supply 107, or a combination thereof can be mounted on the base structure 101. A pump packing lubrication system 108 can be mounted on the base structure 101.

In embodiments, the base structure 101 can further comprise one or more mounting points/elements 115, and each of the one or more pump modules 150 can comprise one or more complementary mounting points/elements 116, configured such that each of the one or more mounting points 115 of the base structure 101 are configured to receive/align with one or more of the one or more complementary mounting elements 116 of the one or more pump modules 150, to position and/or align the pump module 150 (e.g., a driveline 135 thereof) with the electric motor 110 (e.g., with a motor shaft 111 thereof).

Figure 2:
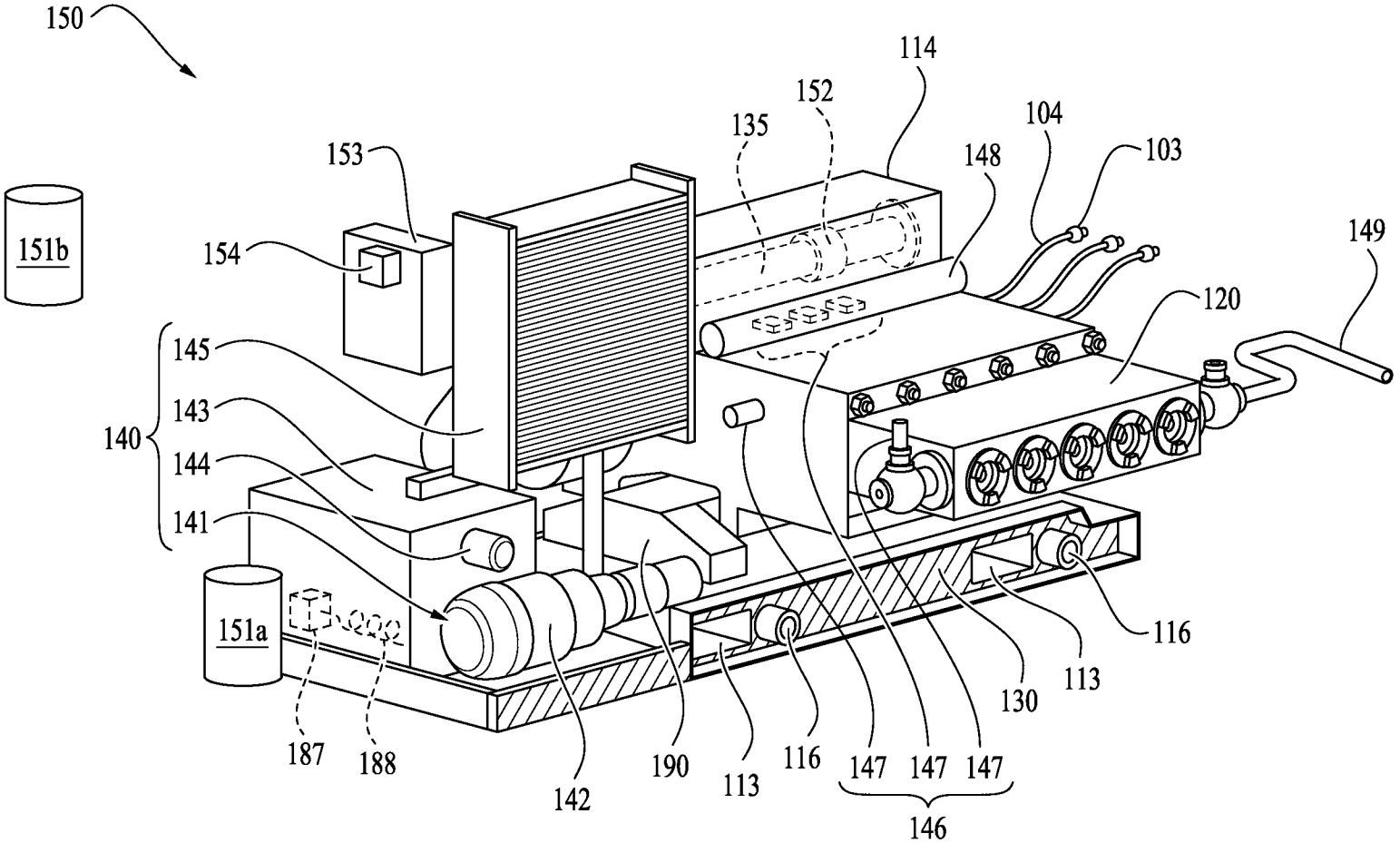
FIG. 2 is a schematic of an exemplary pump module, according to embodiments of this disclosure.

FIG. 2 is a schematic of an exemplary pump module 150, providing additional details about exemplary pumps 120. In embodiments, each of the one or more pump modules 150 can comprise the pump module structure 130, the pump 120, a driveline 135, and pump auxiliary systems 140. The pump auxiliary systems 140 can comprise an oil lubrication pump 141, an oil reservoir 143, one or more oil filters 144, an oil cooler 145, an oil heater 187, a sensor package 146 (e.g., comprising one or more sensors 147 for monitoring pressure, temperature, position), a driveline 135 ("driveshaft assembly"), or a combination thereof. The oil lubrication pump 141 can be powered by an auxiliary electric motor 142, in embodiments. Oil cooler 145 can comprise a heat exchanger (e.g., radiator having oil circulating therein) and a fan, in embodiments. The oil heater 187 can comprise a heat exchanger or heating element such as an electrical resistance heating element 188 disposed within the oil reservoir 143 or a heating jacket disposed around all or a portion of the oil reservoir 143. The oil cooler and/or heater can be controlled by control systems 153 responsive to temperature of the oil and/or ambient temperature sensed by one or more sensors of the sensor package 146. The pump auxiliary systems 140 can further comprise a suction manifold 148 and a discharge manifold 149 with connectors for piping, a pump packing lubrication system 151, a driveshaft clutch and/or driveshaft decoupler 152, electrical cables and/or hoses 104, control systems 153, or a combination thereof.

Each of the pump modules 150 can comprise cables and/or hoses 104 that extend to one or more connector panels 102 mounted on the base structure 101. For example, two connector panels 102 are depicted in the embodiments of FIG. 1. However, in embodiments, a single connector panel 102 can be utilized for one, two, or more pump modules 150, or a plurality of connector panels 102 can be associated with each pump module 150. In embodiments, connector panel 102 can be mounted on base structure 101 (rather than on pump module structure 130). One or more cables (e.g., electrical cables) and/or hoses 104 can connect the connector panel 102 with (e.g., components of) pump module 150. A receptacle/connector 103 of the connector panel 102 can receive electrical supply for the pumping unit 100.

Each of the one or more pump modules 150 can further comprise one or more lift components 113 configured for removal of each of the one or more pump modules 150 from the base structure 101. The lifting components 113 are not particularly limited, and can comprise, for example, one or more forklift pockets, lifting eyes, or a combination thereof.

As depicted in FIG. 2, each of the one or more pump modules 150 can further comprise guarding 114, such as configured for rotating or otherwise moving one or more components of the pump module 150; deflectors, trays, and/or tanks, such as for directing or containing fluids; or a combination thereof.

The electric motor 110 can comprise a first drive shaft 111A and a second drive shaft 111B. In such embodiments, as depicted in FIG. 1, the pumping unit 100 can comprise two pump modules 150, with a first pump module 150A and a second pump module 150B. First pump module 150A is connected to the first drive shaft 111A and second pump module 150B is connected to the second drive shaft 111B, whereby the two pump modules 150 can be driven by the single electric motor 110. The pumping unit 100 can be designed to operate with a single pump module 150 or more pump modules 150 (e.g., with exactly two pump modules 150).

As depicted in FIG. 2, each of the one or more pump modules 150 can further comprise a pump packing lubrication system 151*a* (e.g., a "packing grease system"), and/or can be connected to a remote pump packing grease system 151*b*, and have no fluid connections from the pump packing lubrication system 151 to the base structure 101.

One or more of the pump module(s) 150 can comprise a pump life monitoring system 154 that is operable to provide component identification, data processing, data storage and/or communications (e.g., internal and/or external), or a combination thereof. In this manner, life data for each pump module 150 can be monitored and tracked (e.g., independently of the life of a pumping unit 100 itself).

As noted herein, pump 120 of each pump module 150 can comprise a triplex or quintuplex plunger pump (e.g., positive displacement pump), in embodiments. Pump 120 of each of the one or more pump modules 150 can be mounted onto the pump module structure 130 of the each of the one or more pump modules 150 in a manner designed to reduce and/or prevent translation of flexure of the pump module structure 130 to the pump 120. For example, in embodiments, pump 120 of each of the one or more pump modules 150 can be mounted onto the pump module structure 130 of the each of the one or more pump modules 150 via a three-point mounting sub-structure 190 that reduces and/or prevents translation of flexure of the pump module structure 130 to the pump 120.

Additionally, or alternatively, pump 120 of one or more pump modules 150 can be a centrifugal pump. A centrifugal pump for pumping wellbore servicing fluids downhole comprises a housing having an inlet and an outlet, and a rotating impeller disposed within the housing. The impeller has a plurality of vanes extending radially outwardly from a central hub and is mounted on a shaft that is driven by the electric motor. The impeller rotates at high speed, creating a centrifugal force that propels the wellbore servicing fluid (e.g., fracturing fluid) through the pump and into the wellbore via a manifold and associate piping fluidically coupling the pump 120 to the wellbore.

Each of the one or more pump modules 150 is driven by the electric motor 110 via connection of a driveline 135 of each of the pump modules 150 with a shaft 111 of the electric motor 110. In embodiments, the driveline can comprise a driveshaft clutch and/or a driveshaft decoupler 152, whereby rotary motion can be prevented from being transmitted from the electric motor 110 to pump 120.

While the specific exemplary pumping units and/or pumps described herein may be in the context of an exemplary modular pumping unit, many of the same basic elements would be shared with conventional, non-modular pumping units, as persons of skill would understand. The discussion of exemplary pumping units is not intended to be limiting, but merely provides examples for context. The systems and method of improved pump maintenance described herein can apply to both modular and non-modular pumping units.

One or more pumping units 100 can be used within a wellbore servicing system 200. An embodiment of a wellbore servicing system 200 and a method of servicing a wellbore via the wellbore servicing system 200 will now be described with reference to FIG. 3, which is a schematic representation of an embodiment of a wellbore servicing system 200. For simplicity and clarity, components of pumping units 100 and pump modules 150 other than pumps 120 and electric motors 110 have been omitted from FIG. 3.

A method of servicing a wellbore 224 using a pumping unit 100 can comprise fluidly coupling a pump 120 of a pumping unit 100 to a source of a wellbore servicing fluid (e.g., a wellbore services manifold trailer 204) and to the wellbore 224 (e.g. via the wellbore services manifold trailer 204), and communicating wellbore servicing fluid into the wellbore 224 via the pump 120. The pump 120 can comprise a pump fluid end and a pump power end. The pump power end is operable to reciprocate a reciprocating element within a reciprocating element bore of the pump fluid end.

The method of servicing the wellbore can comprise connecting a fluid inlet (e.g., suction or suction manifold 148) on each of the one or more pump modules 150 to a source of a wellbore servicing fluid (e.g., a wellbore services manifold trailer 204), connecting a fluid outlet (e.g., outlet or discharge manifold 149) on each of the one or more pump modules 150 to a well, and operating each of the one or more pump modules 150 via the electric motor 110 to pump the wellbore servicing fluid (e.g., fracturing fluid) into the wellbore 224 and surrounding formation (e.g., to fracture the subterranean formation). The method can further comprise recovering oil and/or gas (e.g., hydrocarbons) from the wellbore 224 (e.g., flowing to the wellbore via the fractured subterranean formation).

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, diverter fluids, sealants, drilling fluids, completion fluids, gelation fluids, polymeric fluids, aqueous fluids, oleaginous fluids, etc.

In embodiments, the wellbore servicing system 200 comprises one or more pumping units 100 operable to perform oilfield and/or well servicing operations. The oilfield and/or well servicing operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 120 disclosed herein may be employed in any suitable operation. Each of the one or more pumping units 100 comprises one or a plurality of pump modules 150, and each of the one or more pump modules 150 comprises one or a plurality of pumps 120 operated by an electric motor 110, as detailed hereinabove.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

Figure 3:
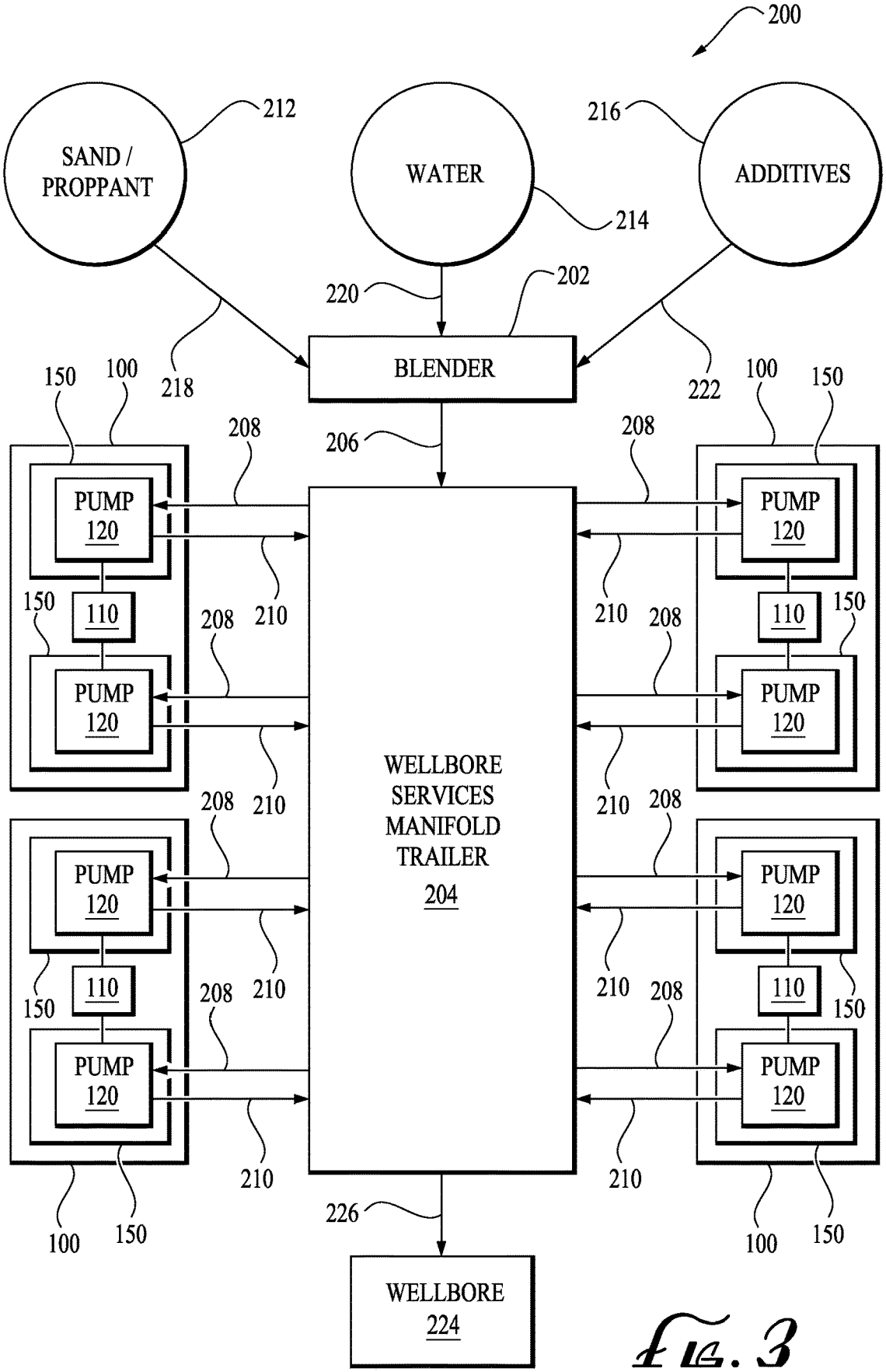
FIG. 3 is a schematic representation of an overview of an exemplary wellbore servicing system, according to embodiments of this disclosure.

For example, the wellbore servicing system 200 of the embodiment of FIG. 3 comprises a blender 202 that is coupled to a wellbore services manifold trailer 204 via flowline 206. As used herein, the term "wellbore services manifold trailer" or the term "wellbore services manifold system" can be used interchangeably and can include a truck, trailer, skid, and/or any other wellbore servicing fluid source comprising one or more manifolds for receiving, organizing, and/or distributing wellbore servicing fluids during wellbore servicing operations. While in some embodiments, the wellbore services manifold trailer may be mobile, in other embodiments it may be fixed. In the embodiment of FIG. 3, the wellbore services manifold trailer 204 is coupled to eight positive displacement pumps 120 via outlet flowlines 208 (e.g., connected to suction manifolds 148 of pump module(s) 150) and inlet flowlines 210 (e.g., connected to discharge flow lines 149 of pump modules 150). In alternative embodiments, however, there may be more or less pumps used in a wellbore servicing operation. Outlet flowlines 208 are outlet lines from the wellbore services manifold trailer 204 that supply fluid to the pumps 120. Inlet flowlines 210 are inlet lines from the pumps 120 that supply fluid to the wellbore services manifold trailer 204. One or more (e.g., two adjacent) pumps 120 can be mounted on a pumping unit 100.

The blender 202 can be utilized/operable to mix or otherwise combine solid and fluid components of the wellbore servicing fluid to achieve a well-blended wellbore servicing fluid. As depicted, in embodiments, sand or proppant 212, water 214, and/or additives 216 can be fed into the blender 202 via feedlines 218, 220, and 222, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 120 pressurize the wellbore servicing fluid to a pressure suitable for delivery into a wellbore 224 or wellhead. For example, the pumps 120 can increase the pressure of the wellbore servicing fluid to a pressure of greater than or equal to about 3,000 psi, 5,000 psi, 10,000 psi, 20,000 psi, 30,000 psi, 40,000 psi, or 50,000 psi, or higher, in embodiments.

From the pumps 120, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 224 of between about 1 BPM to about 200 BPM, alternatively from between about 50 BPM to about 150 BPM, alternatively about 100 BPM. In embodiments, pumps 120 discharge wellbore servicing fluid at a fluid flow rate of between about 1 BPM to about 200 BPM, alternatively from between about 50 BPM to about 150 BPM, alternatively about 100 BPM. In embodiments, the pumps 120 discharge wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Persons of ordinary skill in the art with the aid of this disclosure will appreciate that the flowlines described herein are piping that are connected together for example via flanges, clamps, collars, welds, etc. These flowlines may include various configurations of pipe tees, elbows, and the like. These flowlines connect together the various wellbore servicing fluid process equipment described herein.

Having discussed exemplary pumping units and wellbore servicing systems 200 as context, this disclosure turns now to describing in detail improved techniques for safely performing maintenance on a pump of a pumping unit. Disclosed herein are system and method embodiments which may allow for maintenance to be performed safely on a pump (e.g. on a fluid end of a pump) of a pumping unit, for example even while the pumping unit is located within what would normally be considered the red zone of a pressurized wellbore services manifold trailer, the pumping unit is connected (e.g. via fluid flowlines) to the wellbore services manifold trailer, and/or other (e.g. adjacent) pumping units are still pressurized and providing continuous pressurized fluid to the wellbore services manifold trailer.

Figure 4:
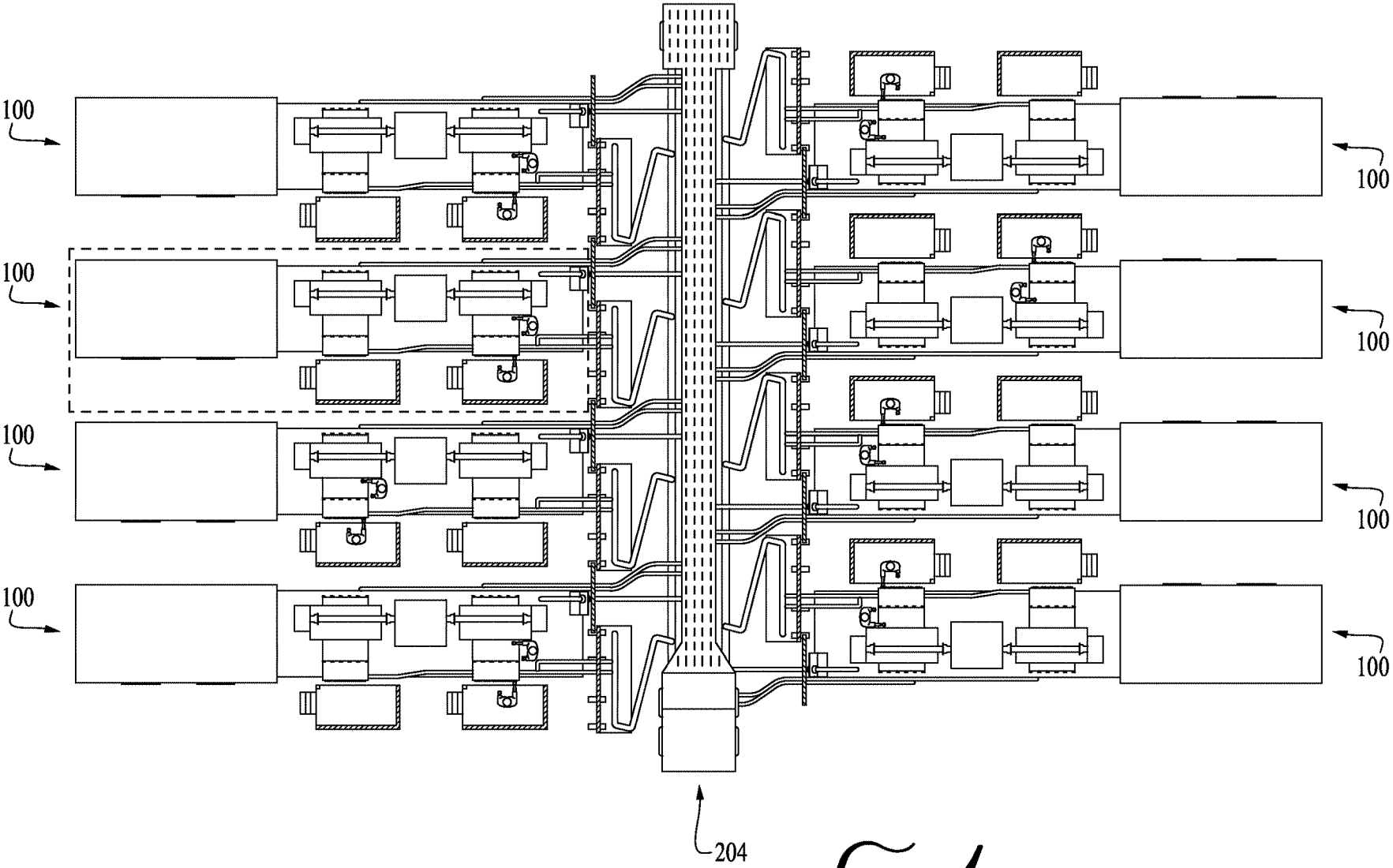
FIG. 4 is a schematic of an exemplary wellbore services system, according to embodiments of this disclosure.

FIG. 4 is a schematic view illustrating an exemplary wellbore services system 200, according to embodiments of this disclosure. As shown in FIG. 4, one or more pumping units 100 may be fluidly coupled to a wellbore services manifold trailer. In some embodiments, the wellbore services manifold trailer may be similar to wellbore services manifold trailer 204. In some embodiments, one or more of the pumping units 100 may extend approximately perpendicularly to the wellbore services manifold trailer 204. While FIG. 4 illustrates eight pumping units 100 coupled to the wellbore services manifold trailer 204, this is merely exemplary. As shown in FIG. 4, in embodiments, one or more pumping units 100 may be coupled to and disposed on either side of the wellbore services manifold trailer 204. And as shown in FIG. 4, in embodiments, each pumping unit 100 may have up to two adjacent pumping units (e.g. disposed adjacent, approximately parallel to, and offset from the pumping unit 100 in question). For reference, the pumping unit 100 may have a fluid end adjacent pumping unit (e.g. disposed to the side of the pumping unit 100 in question, next to the fluid end 374 of the pump 120 of the pumping unit 100 in question—see for example FIG. 7) and a power end adjacent pumping unit (e.g. disposed to the side of the pumping unit 100 in question, next to the power end 372 of the pump 120 of the pumping unit 100 in question—see for example FIG. 7).

Figure 5:
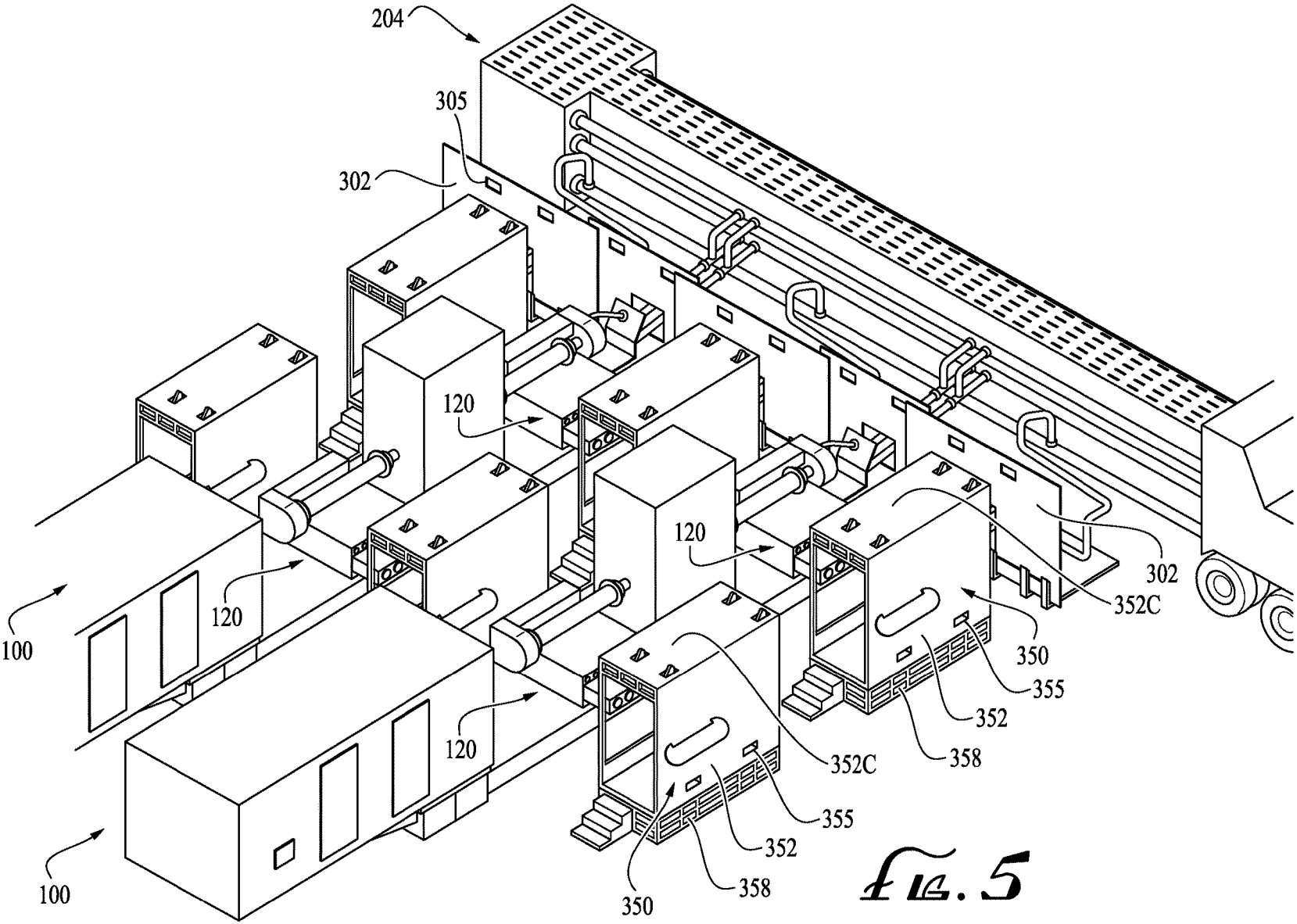
FIG. 5 is an isometric view of a portion of the wellbore services system of FIG. 4, according to embodiments of this disclosure.
Figure 6:
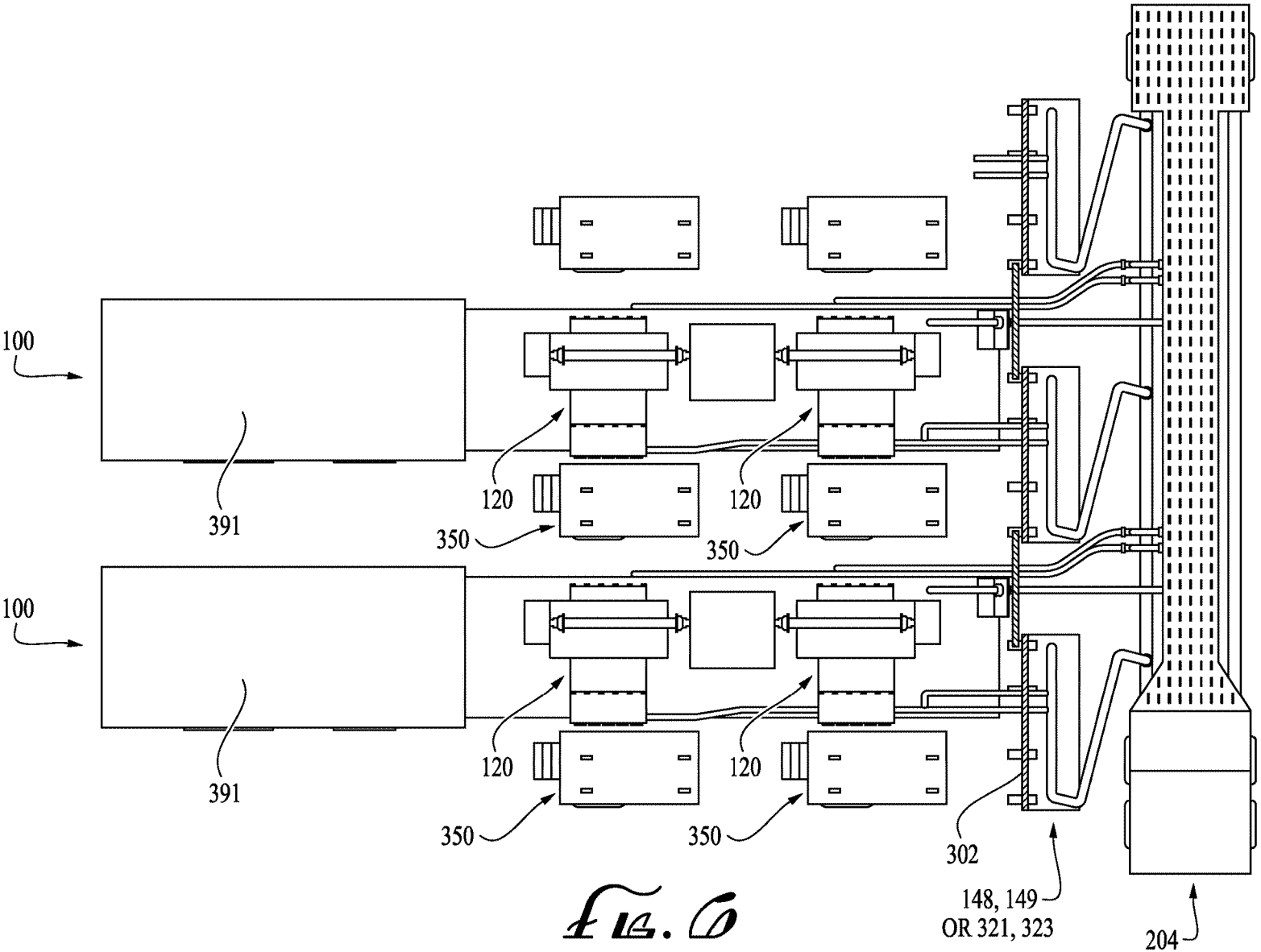
FIG. 6 is an overhead plan view of a portion of the wellbore services system of FIG. 4, according to embodiments of this disclosure.

FIG. 5 is an isometric view of an exemplary portion of the wellbore services system 200 of FIG. 4, and FIG. 6 is an overhead plan view of the exemplary portion of the wellbore services system 200 of FIG. 4. The system 200 may be configured for providing maintenance to a pumping unit 100 fluidly coupled to a pressurized wellbore services manifold trailer 204, for example while the pumping unit 100 is located in a red zone around and/or still coupled (e.g. via flowlines) to the wellbore services manifold trailer 204. In other words, the system 200 may allow for maintenance to be safely performed without moving the pump 120 or the pumping unit 100 out of the red zone, without moving the pump 120 or the pumping unit 100 away from the wellbore services manifold trailer 204, and/or without disconnecting the lines linking the pump 120 to the wellbore services manifold trailer 204.

As best shown in FIGS. 5-6, a ballistic barrier 302 can be disposed between the pumping unit 100 and the wellbore services manifold trailer 204. The ballistic barrier 302 can be configured to effectively shield a worker performing maintenance on a pump 120 of the pumping unit 100 from the pressurized wellbore services manifold trailer 204 (e.g. providing the worker with safety from the danger presented by highly pressurized fluid in the wellbore services manifold trailer 204). An outlet flowline 208 can extend from the wellbore services manifold trailer 204 to the pump 120, physically connecting the pump 120 to the wellbore services manifold trailer 204. The outlet flowline 208 can be configured to supply fluid to the pump 120, for example at low pressure (e.g. approximately 100 psi). An inlet flowline 210 can extend from the pump 120 to the wellbore services manifold trailer 204, physically connecting the pump 120 to the wellbore services manifold trailer 204. The inlet flowline 210 can be configured to supply pressurized fluid to the wellbore from the pump 120, for example at high pressure (e.g. approximately 15,000 psi). In embodiments, the inlet flowline 210 can include an inlet flowline valve 323 having an open position allowing fluid flow from the pump 120 to the wellbore services manifold trailer 204 and a closed position blocking fluid flow from the pump 120 to the wellbore services manifold trailer 204. The inlet flowline valve 323 can be disposed between the wellbore services manifold trailer 204 and the ballistic barrier 302 (e.g. with the ballistic barrier 302 between the inlet flowline valve 323 and the pumping unit 100). In embodiments, the inlet flowline valve 323 can be offset from any opening in the ballistic barrier 302 (for example, an opening allowing passage of the inlet flowline 210 therethrough), so that a portion of the barrier 302 may be disposed directly between the inlet flowline valve 323 and the pumping unit 100. In embodiments, the inlet flowline valve 323 can be configured for remote activation/operability between the open and closed positions (e.g. via remotely controlled actuator). By way of example, the remotely controlled actuator can be one selected from the following: plug valve, gate valve, and ball valve. Some embodiments may comprise an optional second inlet flowline valve, which may provide for redundancy and safety). The second inlet flowline valve can be similar to the first inlet flowline valve 323.

In embodiments, the outlet flowline 208 can comprise an outlet flowline valve 321 having an open position allowing fluid flow from the wellbore services manifold trailer 204 to the pump 120 and a closed position blocking fluid flow from the wellbore services manifold trailer 204 to the pump 120. In embodiments, the outlet flowline valve 321 can be configured for remote activation between the open and closed positions (e.g. via remotely controlled actuator). In embodiments, the outlet flowline valve 321 can be disposed between the wellbore services manifold trailer 204 and the ballistic barrier 302 (e.g. the ballistic barrier 302 may be disposed between the outlet flowline valve 321 and the pumping unit 100).

In some embodiments, the inlet flowline valve 323 can be disposed within the discharge manifold 149 and the outlet flowline valve 321 can be disposed in the suction manifold 148. Jointly, the inlet flowline valve 323 and the outlet flow valve can provide the ability to remotely isolate the pump 120 from the wellbore services manifold trailer 204, even while the pump 120 is connected to the wellbore services manifold trailer 204 and/or when additional pumping units connected to the wellbore services trailer are in operation providing pressurized fluid to the wellbore services manifold trailer 204, such that the wellbore services manifold trailer 204 is pressurized.

The system can further comprise a bleed off line 331 fluidly coupled to the pump 120. For example, the bleed off line 331 can be configured to allow fluid in the pump 120 and inlet flowline 210 to be bled off (e.g. depressurizing the pump 120 and/or inlet flowline 210), for example to a holding tank. In some embodiments, the fluid in the outlet flowline 208 may also be bled off using the bleed off line 331, for example as the pressure would bleed through the pump. In embodiments, the bleed off line 331 can comprise a bleed off valve 332 having a closed position preventing fluid flow into the bleed off line 331 and an open position allowing fluid flow into the bleed off line 331. In embodiments, the bleed off valve 332 can be configured for remote activation between the open and closed positions (e.g. via remotely controlled actuator). Closing the inlet and outlet valves (to isolate the pump 120) and bleeding off the pressurized fluid can effectively depressurize the pump 120 (even when the pump 120 is still connected to the pressurized wellbore services manifold trailer 204 and/or when additional pumping units connected to the wellbore services trailer are in operation providing pressurized fluid to the wellbore services manifold trailer 204). Some embodiments may also include sensors. For example, a sensor may note the pressure in the pump 120 and/or the inlet flowline 210 (e.g. so that an operator may determine if the pressure has effectively been bled off). Sensors may also indicate whether particular valves are open or closed. In some embodiments, one or more sensor may have a visual and/or auditory indicator associated therewith. For example, a light may be illuminated automatically when the pressure sensor indicates effective bleed off of pressure, indicating that the system has been isolated and depressurized.

Interposing the ballistic barrier 302 between the pumping unit 100 and the pressurized wellbore services, along with isolating and depressurizing the pump 120 fluidly from the wellbore services manifold trailer 204 (so that the pump 120 does not contain high pressure), can effectively render the red zone into a "safe zone," which is permissible for workers to operate within. For example, the safe zone may be defined by the ballistic barrier 302, the passenger-side edge of the deenergized pumping unit (e.g. the power end of the pump at issue), and the passenger side edge of the adjacent unit (e.g. the power end of the adjacent pumping unit). See for example the exemplary safe zone shown by the dotted box around an exemplary pumping unit 100 in FIG. 4.

The ballistic barrier 302 may be formed of any material sufficient to provide ballistic protection capable of blocking and/or absorbing damage associated with a high-pressure failure event (e.g. so that workers protected by the ballistic barrier 302 can work safely). In some embodiments, the ballistic barrier 302 may comprise one or more steel plates. For example, the one or more steel plates of the ballistic barrier 302 can each comprise approximately 1 inch thick steel plates. Other materials capable of providing sufficient ballistic protection may also be used. Further, the ballistic barrier 302 may be engineered so that its structure can meet the ballistic requirements of the particular system. For example, any structure engineered (for example with respect to material selection and thickness and structural element design) to meet the ballistic requirements of the system can serve as the ballistic barrier 302. In embodiments, the ballistic barrier 302 can comprise an opening for the inlet flowline 210 and/or the outlet flowline 208. For example, each opening may be only slightly larger than the diameter of the corresponding flowline, for example to maximize the protection provided by the ballistic barrier 302. In some embodiments, the ballistic barrier 302 may comprise an opening for an electrical connection. In embodiments, the ballistic barrier 302 can comprise a lift component 305 (e.g. which may be similar to the lift component 113). The lift component 305 may assist with installation of the ballistic barrier 302 in place.

In embodiments, the pumping unit 100 can be configured to allow electric lockout (e.g. depowering) of the pump 120. The electric lockout may be a switch, allowing power to the pump 120 to be turned on or off. In embodiments, the electric lockout can be configured for remote activation (e.g. via remotely controlled actuator). In embodiments, the system can further comprise a flush line 335, which may be configured to allow for flushing of the pump 120 and/or inlet flowline 210. For example, the flush line 335 may be configured to direct clean water (e.g. water from a clean source or water without proppant and/or additives) through the pump 120 and the inlet flowline 210 (for example, pushing proppant, additives, or dirty water out to the wellbore services manifold trailer 204). In some embodiments, the flush line 335 may also be configured to flush the outlet flowline 208. In embodiments, the flush line 335 can be configured for remote activation (e.g. via remotely controlled actuator). For example, the flush line 335 can include a flush line valve 336, which can be remotely operated. In embodiments, the system can further comprise a controller 391 configured to remotely activate/operate the inlet flowline valve 323, the outlet flowline valve 321, the electric lockout, the bleed off valve 332, and/or the flush line valve 336. For example, the controller 391 may be located at the end of the pumping unit 100 furthest from the pump 120.

In embodiments, the ballistic barrier 302 can comprise two or more ballistic panels, for example as shown in FIG. 8. In embodiments, the two or more ballistic panels can be configured to overlap, so that there is no exposed gap between ballistic panels. In embodiments, the ballistic barrier 302 can have a length greater than the width of the pumping unit 100.

In embodiments, the pumping unit 100 can comprise more than one pump 120. For example, the pumping unit 100 can have a plurality, such as two, pumps, as shown in FIG. 8. In some embodiments, each pump 120 of the pumping unit 100 may be individually isolated from the wellbore services manifold trailer 204. In other embodiments, the entire pumping unit 100 may be isolated as a whole from the wellbore services manifold pumping unit 100 (e.g. thereby isolating both pumps 120 on the pumping unit in question).

As shown in FIG. 5, the system may further comprise a secondary barrier 352 disposed on a same side of the ballistic barrier 302 as the pumping unit 100, adjacent to the pump 120. For example, the secondary barrier 352 can be disposed adjacent to a fluid end 374 of the pump 120 (see FIG. 7 for example). In embodiments in which a pumping unit 100 has more than one pump 120, each pump 120 may have a corresponding secondary barrier 352.

Figure 7:
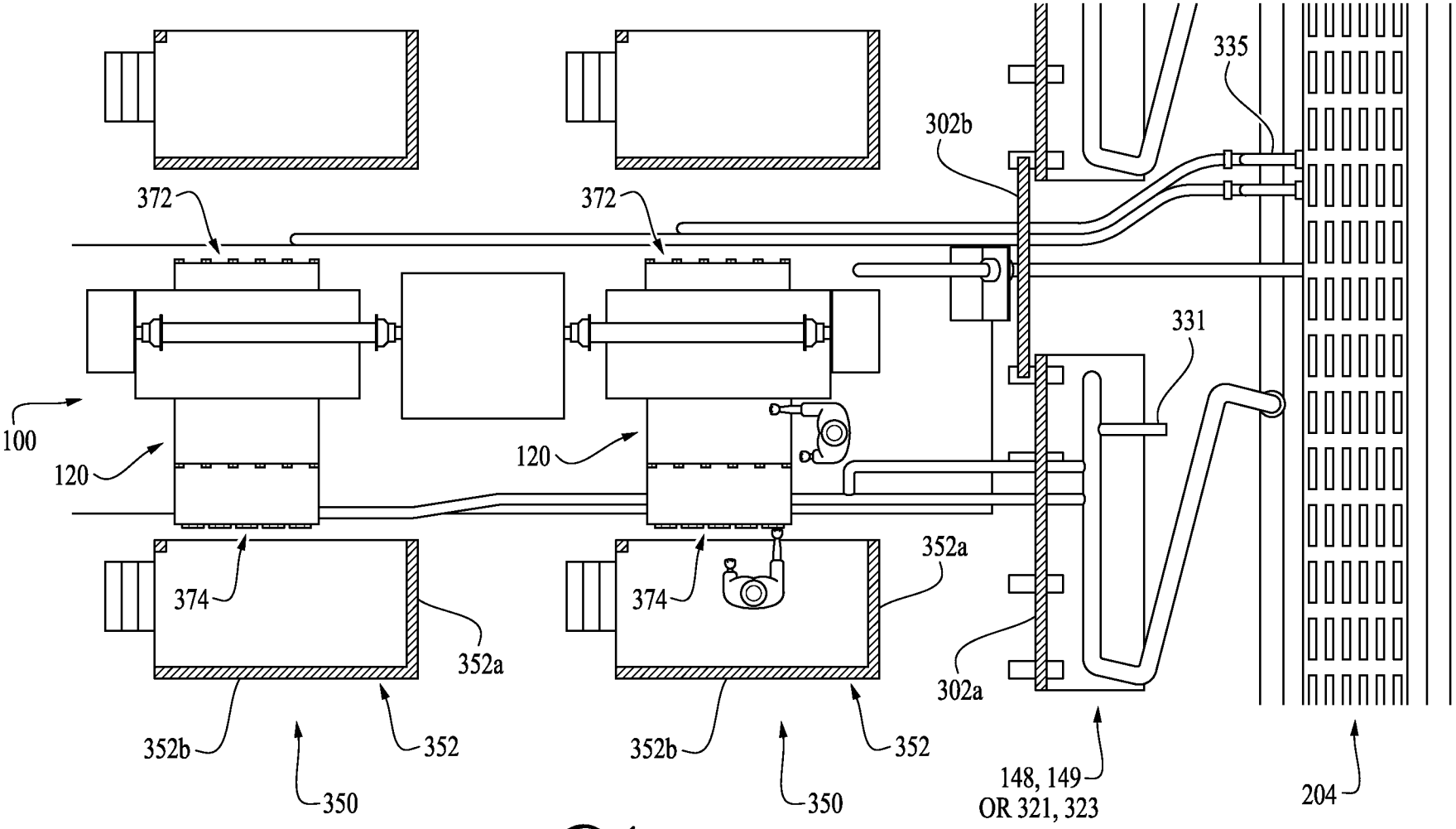
FIG. 7 is a schematic overhead plan view of a portion of the wellbore services system of FIG. 4, according to embodiments of this disclosure.

In embodiments, as shown in FIG. 7, the secondary barrier 352 can comprise a first portion 352*b* disposed in proximity to a fluid end 374 of the pump 120 and disposed between the fluid end 374 of the pump 120 and a power end 372 of an adjacent pumping unit pump (e.g. a fluid end adjacent pumping unit), and a second portion 352*a* oriented towards/facing the ballistic barrier 302 and/or the wellbore services manifold trailer 204. In embodiments, the first portion 352*b* can be positioned to provide protection to a worker located adjacent the fluid end 374 of the pump 120 from secondary impacts and/or spray from the fluid end adjacent pumping unit. In embodiments, the second portion 352*a* can be positioned to provide additional protection (e.g. in addition to the ballistic barrier 302) to a worker located adjacent the fluid end 374 of the pump 120 from high pressure in the wellbore services manifold trailer 204. In embodiments, the first portion 352*b* can extend approximately parallel to the pumping unit 100, approximately parallel to the fluid end adjacent pumping unit, and/or approximately perpendicular to the ballistic barrier 302 and/or the wellbore services manifold trailer 204. In embodiments, the second portion 352*a* can be located along a line extending (e.g. approximately parallel to and) between the pump 120 and the ballistic shield. In embodiments, the first portion 352*b* can extend approximately perpendicular to the second portion 352*a*.

In embodiments, the first portion 352*b* of the secondary barrier 352 can have a length greater than the fluid end 374 of the pump 120. For example, the first portion 352*b* can extend sufficiently to protect a worker adjacent to the fluid end 374 of the pump 120 on the pumping unit 100 (e.g. to be disposed between such a worker and the fluid end adjacent pumping unit). In embodiments, the secondary barrier 352 can be less protective than the ballistic barrier 302. For example, the ballistic barrier 302 can be rated for the high pressures of the wellbore services manifold trailer 204, while the secondary barrier 352 can be rated for lesser, secondary impacts and spray, which may come from the power end 372 of the fluid end adjacent pumping unit pump. In embodiments, the secondary barrier 352 and the ballistic barrier 302 can differ in material and/or thickness. For example, the secondary barrier 352 can be formed of approximately ¼ inch thick mild steel plate, in some embodiments. In alternate embodiments, the secondary barrier 352 and the ballistic barrier 302 may be formed of the same or similarly ballistically protective materials.

The system can further comprise a shielded work platform 350, as shown in FIGS. 4-7, and the shielded work platform 350 can comprise the secondary barrier 352. For example, the secondary barrier 352 may be disposed on or part of the shielded work platform 350, for example as shown schematically in FIG. 7. In embodiments, the first portion 352*b* of the secondary barrier 352 can be disposed between a worker on the shielded work platform 350 and the power end 372 of the adjacent pumping unit. In embodiments, the second portion 352*a* of the secondary barrier 352 can be configured to be disposed between the worker on the shielded work platform 350 and the ballistic barrier 302.

In embodiments, the shielded work platform 350 can further comprise a cover/roof 352*c* (which may provide shade, structural support to the two portions of the secondary barrier 352, and/or additional secondary shielding protecting workers on the shielded work platform 350, for example from overhead secondary impacts and/or spray). See for example, FIGS. 5-6. In embodiments, the shielded work platform 350 can further comprise a base/floor 358, as shown in FIG. 5. In embodiments, the base 358 can be configured to elevate the worker off the ground, for example to place the worker at a height to access the pump 120. For example, the worker may be able to access and perform maintenance on the fluid end of the pump 120 without having to leave the shielded work platform 350. In embodiments, the secondary barrier 352 may be separable from the base 358 of the shielded work platform 350 (e.g. removably attached/coupled).

In embodiments, the shielded work platform 350 can be configured to provide access to the fluid end 374 of the pump 120 (e.g. for a worker standing on the base). For example, the shielded work platform 350 can comprise an open side facing the fluid end 374 of the pump 120 or can comprise one or more openings in a facing wall/panel. In embodiments having a facing wall (e.g. disposed between the worker on the base 358 and the fluid end of the pump 120), the one or more openings therein may be closable, for example via sliding or folding/hinged panels. In embodiments, the secondary barrier 352/shielded work platform 350 can be configured to be movable/repositionable. For example, the secondary barrier 352 and/or the base 358 can comprise a lift component 355, which may be similar to lift component 113. In embodiments, the secondary barrier 352 and/or shielded work platform 350 can be entirely separate and independent of the pumping unit 100 (e.g. not mounted on the pumping unit 100). In embodiments, the secondary barrier 352/shielded work platform 350 can be configured to be anchored to the ground. In embodiments, the ballistic barrier 302 can have a length greater than the joint width of the pumping unit 100 and the shielded work platform 350. In operation, the pump 120 of the pumping unit 100 would typically be disposed between the worker (e.g. the access area of the shielded work platform 350) and the (pressurized) fluid end 374 of a power end adjacent pumping unit, thereby shielding the worker (e.g. from secondary impacts and/or spray) despite the open access area (e.g. the open side of the shielded work platform 350).

As shown in FIGS. 4-6, the system can further comprise one or more additional pumping units 100, each having a similar ballistic barrier 302 disposed between the corresponding one or more additional pumping unit 100 and the wellbore services manifold trailer 204. In embodiments, each pumping unit 100 can be operable to be isolated and depressurized individually (e.g. fluidly isolated from the wellbore services manifold trailer 204 and typically having the pressure then bled off, for example as discussed herein, even while one or more other pumping units 100 operate to pump high pressure fluid to the wellbore services manifold trailer 204). In embodiments, each pumping unit 100 can have a secondary barrier 352 and/or shielded work platform 350 corresponding to each pump 120. For example, the first portion 352*b* of the secondary barrier 352 and/or the shielded work platform 350 can be disposed between adjacent pumping units, for example with the open side facing the fluid end 374 of the pump 120 of the pumping unit 100 to which it corresponds and the first portion 352*b* of the secondary barrier 352 disposed opposite from the open side and facing towards the power end 372 of the fluid end adjacent pumping unit pump. In embodiments, each pumping unit 100 can extend approximately perpendicular to the wellbore services manifold trailer 204 and/or approximately parallel to the one or more adjacent pumping units. In embodiments, the ballistic barrier 302 of adjacent pumping units 100 can overlap. For example, the overlapping ballistic barriers 302 of the plurality of adjacent pumping units can form a continuous barrier between the plurality of pumping units 100 and the wellbore services manifold trailer 204.

Disclosed embodiments also include methods for performing maintenance on a pumping unit 100 that is fluidly coupled to a wellbore services manifold trailer 204 (e.g. while the pump 120 of the pumping unit 100 is connected to the wellbore services manifold trailer 204 by inlet and outlet flowlines and/or is located within the red zone). Advantageously, the methods may allow for maintenance on the fluid end 374 of the pump 120 without the need to move the pump 120 or the pumping unit 100. For example, the methods may allow for a portion of the red zone (e.g. the portion surrounding the pump 120 in question) to be safe enough for workers to operate in (e.g. effectively becoming a safe zone). This may result in less downtime for pump maintenance, and in some embodiments the ability to continue pumping pressurized fluid to the wellbore services manifold trailer 204 with other pumping units even while performing maintenance on a pump 120 (e.g. in what would have been the red zone), increasing the overall efficiency of the system.

Exemplary methods can include providing/disposing ballistic shielding between the wellbore services manifold trailer 204 and the pumping unit 100 (e.g. to create a safe zone); remotely isolating (i.e. fluidly) the pump 120 from the wellbore services manifold trailer 204 (e.g. preventing fluid communication therebetween, even though the pump 120 is still connected to the manifold, for example by closing valves as discussed herein); remotely bleeding off (e.g. pressurized) fluid from the isolated pump 120; and performing maintenance on the pump 120 in situ (e.g. while it is in a portion of the original red zone which is now protected by the ballistic barrier 302 to become a safe zone—e.g. without moving the pump 120) while the pump 120 remains connected to the wellbore services manifold trailer 204 (e.g. with outlet flowlines and inlet flowlines still extending between the pumping unit and the manifold). In such methods, there may be no physical disconnection or moving of the pump 120 or pumping unit 100 away from the wellbore services manifold trailer 204. Optionally, some methods may include remotely flushing a pump 120 of the pumping unit 100 (e.g. with clean water and/or to remove proppant). In some embodiments, this flushing may be performed after closing the outlet flowline valve 321 (so no fluid is entering the pump 120 from the wellbore services manifold trailer 204) and before closing the inlet flowline valve 323, which may push the proppant and/or dirty water out of the pump 120 and into the wellbore services manifold trailer 204. In other embodiments, flushing can be performed after both the inlet and outlet flowline valves have been closed, for example with a flush drain line being then opened to direct the proppant/dirty water out of the pump 120. In some embodiments, the inlet flowline 210 and/or outlet flowline 208 may also be flushed, depending on the location of the flush line 335 within the system.

Typically, at least a portion of the red zone becomes a safe zone (e.g. due to the ballistic shielding). In some embodiments, performing maintenance can comprise performing maintenance on the fluid end 374 of the pump 120, for example changing one or more valves at the fluid end 374 of the pump 120. In some embodiments, remotely isolating the pump 120 can comprise isolating the pump 120 individually (e.g. even while one or more other pumping units and/or pumps are fluidly coupled to the wellbore services manifold trailer 204 and providing pressurized fluid to the wellbore services manifold trailer 204). Indeed, in some embodiments in which the pumping unit 100 comprises more than one pump 120, the other pump(s) on the pumping unit 100 may remain coupled to and providing pressurized fluid to the wellbore services manifold trailer 204, even while the pump 120 in question is isolated for maintenance. In other embodiments, the entire pumping unit 100 may be isolated for additional safety. In some embodiments, performing maintenance on the pump 120 in situ can comprise performing maintenance on the pump 120 while one or more adjacent pumping units are still pumping pressurized fluid to the wellbore services manifold trailer 204 and/or while the wellbore services manifold trailer 204 is pressurized (e.g. under high pressure) and providing pressurized fluid to the well.

Some method embodiments can further comprise locking out (e.g. de-energizing) the pump 120. For example, the pump 120 can be electrically depowered, for example by disconnecting the pump 120 from its power source. In some embodiments, this locking out can be performed remotely, for example using an actuator-operated switch to "turn off" the pump 120. Some method embodiments can further comprise disposing a secondary barrier 352 on a same side of the ballistic barrier 302 as the pumping unit 100, adjacent to the pump 120 (e.g. adjacent the fluid end 374 of the pump 120). In some embodiments, performing maintenance on the pump 120 can comprise performing maintenance while shielded by the secondary barrier 352 (e.g. in addition to the ballistic barrier 302). In embodiments, the secondary barrier 352 can comprise a first portion 352*b* disposed between a fluid end 374 of the pump 120 and a power end 372 of an adjacent pumping unit pump (e.g. a fluid end adjacent pumping unit), and a second portion 352*a* oriented towards/facing the ballistic barrier 302 and/or the wellbore services manifold trailer 204. For example, the first portion 352*b* of the secondary barrier 352 can be disposed between a worker on a shielded work platform 350 and the power end 372 of the adjacent pumping unit, while the second portion 352*a* can be disposed between the worker on the shielded work platform 350 and the ballistic barrier 302. In embodiments, the secondary barrier 352 can be less protective that the ballistic barrier 302.

Method embodiments can further comprise (e.g. after maintenance on the pump 120 is completed) remotely re-priming the pump 120; remotely pressure testing the re-primed pump 120; remotely re-powering the pump 120 (e.g. electrically unlocking the pump 120 to reconnect the pump 120 to its power source); remotely re-establishing fluid communication between the pump 120 and the wellbore services manifold trailer 204 (e.g. by opening the inlet and outlet flowline valves to de-isolate the pump 120); and/or providing pressurized fluid once again from the pump 120 to the wellbore services manifold trailer 204. In this manner, the pump 120 of a pumping unit 100 may be serviced without moving it out of the red zone (e.g. while the pump 120 stays in position in situ and is still physically connected via lines to the wellbore services manifold trailer 204). This method can be performed on one or more pumps of a system having a plurality of pumping units coupled to the wellbore services manifold trailer 204, which may allow for continuous, un-interrupted pumping of pressurized fluid to the wellbore services manifold trailer 204 (and thereby to the well).

Advantageously, because this method/system allows for pump maintenance with minimal disruption to the pumping operation, it may allow users to perform preventive maintenance, rather than simply fixing pumps when they break/fail. In other words, proactive maintenance may be easier to perform, which may ultimately provide for improved system performance (e.g. since replacing a worn part before failure can reduce collateral damage to other parts of the pump, which may thereby reduce the amount of maintenance work that needs to be performed). In some method embodiments, performing maintenance can comprise performing preventative maintenance on the pump, for example based on a pre-set schedule (which may be designed to have maintenance performed before a historical failure point), rather than waiting for pump failure. In some method embodiments, preventative maintenance can comprise inspection of the pump. For example, regular inspection of the pump may identify potential failure points before they actually fail and/or may allow for accumulation of data which may inform the pre-set schedule for maintenance. In embodiments having a modular pumping unit, it may be possible to remove the pump module (e.g. if the pump cannot effectively be repaired on site) even while the wellbore services manifold trailer is pressurized (e.g. due to the ballistic shielding creating a safe zone). In some embodiments, removing the pump module (as discussed herein) may include moving (e.g. using the lift component 355) the shielded work platform 350.

Additional Disclosure

The following are non-limiting, specific embodiments in accordance with the present disclosure:

In a first embodiment, a system comprises: a ballistic barrier disposed between a pumping unit and a wellbore services manifold trailer and configured to effectively shield a worker performing maintenance on a pump of the pumping unit from the pressurized wellbore services manifold trailer; an outlet flowline configured to supply fluid from the wellbore services manifold trailer to the pump; and an inlet flowline configured to supply fluid from the pump to the wellbore services manifold trailer; wherein the inlet flowline comprises an inlet flowline valve having an open position allowing fluid flow from the pump to the wellbore services manifold trailer and a closed position blocking fluid flow from the pump to the wellbore services manifold trailer; wherein the inlet flowline valve is disposed between the wellbore services manifold trailer and the ballistic barrier; and wherein the inlet flowline valve is configured for remote activation between the open and closed positions.

A second embodiment can include the system of the first embodiment, wherein the outlet flowline comprises an outlet flowline valve having an open position allowing fluid flow from the wellbore services manifold trailer to the pump and a closed position blocking fluid flow from the wellbore services manifold trailer to the pump; and wherein the outlet flowline valve is configured for remote activation between the open and closed positions.

A third embodiment can include the system of the first or second embodiments, further comprising a bleed off line fluidly coupled to the pump, the bleed off line comprising a remotely operable bleed off valve having a closed position preventing fluid flow into the bleed off line and an open position allowing fluid flow into the bleed off line.

A fourth embodiment can include the system of any one of the first to third embodiments, wherein the ballistic barrier comprises one or more steel plates, and optionally the one or more steel plates of the ballistic barrier each can comprise approximately 1 inch thick steel plates.

A fifth embodiment can include the system of any one of the first to fourth embodiments, wherein the pump unit is configured to allow remotely operable electric lockout of the pump.

A sixth embodiment can include the system of any one of the first to fifth embodiments, further comprising a remotely operable flush line configured to direct clean water through the pump and the inlet flowline.

A seventh embodiment can include the system of any one of the first to sixth embodiments, further comprising one or more additional pumping units, each having a similar ballistic barrier disposed between the corresponding one or more additional pumping unit and the wellbore services manifold trailer, wherein each pumping unit is operable to be isolated individually from the wellbore services manifold trailer.

An eighth embodiment can include the system of any one of the first to seventh embodiments, further comprising a secondary barrier disposed on a same side of the ballistic barrier as the pumping unit, adjacent to the pump, wherein the secondary barrier comprises a first portion disposed in proximity to a fluid end of the pump and disposed between the fluid end of the pump and a power end of an adjacent pumping unit pump, and a second portion facing the ballistic barrier and the wellbore services manifold trailer.

A ninth embodiment can include the system of the eighth embodiment, wherein the secondary barrier is less protective than the ballistic barrier.

In a tenth embodiment, a secondary barrier comprises: a first portion configured to be disposed in proximity to a fluid end of a pump and disposed between the fluid end of the pump and a power end of an adjacent pumping unit pump; and a second portion configured to face a ballistic barrier and/or a wellbore services manifold trailer; wherein the secondary barrier is less protective than the ballistic barrier.

An eleventh embodiment can include the barrier of the tenth embodiment, wherein the secondary barrier and the ballistic barrier differ in material and/or thickness.

A twelfth embodiment can include the barrier of the tenth or eleventh embodiments, further comprising a shielded work platform, wherein the first portion and the second portion are disposed on the shielded work platform.

A thirteenth embodiment can include the barrier of the twelfth embodiment, wherein the shielded work platform further comprises a cover.

A fourteenth embodiment can include the barrier of the twelfth or the thirteenth embodiments, wherein the shielded work platform further comprises an elevated base.

A fifteenth embodiment can include the barrier of any one of the twelfth to the fourteenth embodiments, wherein the shielded work platform is configured to provide access to the fluid end of the pump for a worker in the shielded work platform.

In a sixteenth embodiment, a method for performing maintenance on a pump of a pumping unit comprises: disposing ballistic shielding between a wellbore services manifold trailer and the pumping unit; remotely isolating the pump from the wellbore services manifold trailer; remotely bleeding off fluid from the isolated pump; and performing maintenance on the pump in situ while the pump remains connected to the wellbore services manifold trailer.

A seventeenth embodiment can include the method of the sixteenth embodiment, further comprising disposing a secondary barrier on a same side of the ballistic barrier as the pumping unit, adjacent to the pump.

An eighteenth embodiment can include the method of the seventeenth embodiment, wherein the secondary barrier is less protective than the ballistic barrier.

A nineteenth embodiment can include the method of the seventeenth or eighteenth embodiments, wherein performing maintenance on the pump comprises performing maintenance while shielded by the secondary barrier, wherein the secondary barrier comprises a first portion disposed between a fluid end of the pump and a power end of an adjacent pumping unit pump, and a second portion facing the ballistic barrier and the wellbore services manifold trailer.

A twentieth embodiment can include the method of any one of the sixteenth to the nineteenth embodiments, further comprising remotely re-priming the pump, remotely re-establishing fluid communication between the pump and the wellbore services manifold trailer, and/or providing pressurized fluid from the pump to the wellbore services manifold trailer.

In a twenty-first embodiment, a wellbore servicing system comprising the system of any one of the first to the ninth embodiments fluidly coupled to a wellbore services manifold system configured for delivering pressurized fluid to a wellbore.

In a twenty-second embodiment, supplying fluid, which may include water mixed with proppant and/or additives, to the wellbore servicing system of the twenty-first embodiment, and operation of same to pump the fluid from the surface into the well.

A twenty-third embodiment can include the method of the twenty-second embodiment, further comprising performing maintenance on a pump of one of a plurality of pumping units while others of the pumping units continue to provide pressurized fluid to the wellbore services manifold system.

A twenty-fourth embodiment can include the method of the twenty-third embodiment, wherein performing maintenance comprises safely performing maintenance on a fluid end of the pump without physically disconnecting and/or removing the pump from proximity to the wellbore services manifold system and/or others of the plurality of pumping units.

A twenty-fifth embodiment can include the method of the twenty-fourth embodiment, wherein safely performing maintenance comprises rendering a red zone into a safe zone by placement of the ballistic barrier and/or secondary barrier.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. A system for providing maintenance to a pumping unit fluidly coupled to a pressurized wellbore services manifold system, comprising:

a ballistic barrier disposed between the pumping unit and the wellbore services manifold system and configured to effectively shield a worker performing maintenance on a pump of the pumping unit from the pressurized wellbore services manifold system;

an outlet flowline configured to supply fluid from the wellbore services manifold system to the pump; and an inlet flowline configured to supply fluid from the pump to the wellbore services manifold system;

wherein the inlet flowline comprises an inlet flowline valve having an open position allowing fluid flow from the pump to the wellbore services manifold system and a closed position blocking fluid flow from the pump to the wellbore services manifold system;

wherein the inlet flowline valve is disposed between the wellbore services manifold system and the ballistic barrier; and wherein the inlet flowline valve is configured for remote activation between the open and closed positions.

2. The system of claim 1, wherein:

the outlet flowline comprises an outlet flowline valve having an open position allowing fluid flow from the wellbore services manifold system to the pump and a closed position blocking fluid flow from the wellbore services manifold system to the pump; and the outlet flowline valve is configured for remote activation between the open and closed positions.

3. The system of claim 2, further comprising a bleed off line fluidly coupled to the pump, the bleed off line comprising a remotely operable bleed off valve having a closed position preventing fluid flow into the bleed off line and an open position allowing fluid flow into the bleed off line.

4. The system of claim 3, wherein the pumping unit is configured to allow safely accessible electric lockout of the pump.

5. The system of claim 3, further comprising a remotely operable flush line configured to direct clean water through the pump and the inlet flowline.

6. The system of claim 1, wherein the ballistic barrier comprises one or more steel plates, and wherein the ballistic barrier is configured to be ballistically protective in the system.

7. The system of claim 1, further comprising additional ballistic barriers disposed between corresponding additional pumping units and the wellbore services manifold system, wherein each of the additional pumping units is operable to be isolated individually from the wellbore services manifold system.

8. The system of claim 1, further comprising a secondary barrier disposed on a same side of the ballistic barrier as the pumping unit, adjacent to the pump, wherein the secondary barrier comprises a first portion disposed in proximity to a fluid end of the pump and disposed between the fluid end of the pump and a power end of an adjacent pumping unit pump, and a second portion facing the ballistic barrier and the wellbore services manifold system.

9. The system of claim 8, wherein the secondary barrier is less protective than the ballistic barrier.

10. The system of claim 9, wherein the secondary barrier and the ballistic barrier differ in material or thickness.

11. The system of claim 10, further comprising a shielded work platform, wherein the first portion and the second portion are disposed on the shielded work platform.

12. The system of claim 11, wherein the shielded work platform further comprises a cover.

13. The system of claim 12, wherein the shielded work platform further comprises an elevated base.

14. The system of claim 11, wherein the shielded work platform is configured to provide access to the fluid end of the pump for a worker on the shielded work platform.

15. The system of claim 8, wherein a length of the secondary barrier is greater than a length of the fluid end of the pump.

16. A method for performing maintenance on a pump of a pumping unit fluidly coupled to a wellbore services manifold system, comprising:

providing the system of claim 1;

remotely isolating the pump from the wellbore services manifold system;

remotely bleeding off fluid from the isolated pump; and performing maintenance on the pump in situ while the pump remains connected to the wellbore services manifold system.

17. The method of claim 16, further comprising disposing a secondary barrier on a same side of the ballistic barrier as the pumping unit, adjacent to the pump.

18. The method of claim 17, wherein the secondary barrier is less protective than the ballistic barrier.

19. The method of claim 17, wherein performing maintenance on the pump comprises performing maintenance while shielded by the secondary barrier, wherein the secondary barrier comprises a first portion disposed between a fluid end of the pump and a power end of an adjacent pumping unit pump, and a second portion facing the ballistic barrier and the wellbore services manifold system.

20. The method of claim 19, further comprising remotely re-priming the pump, remotely re-establishing fluid communication between the pump and the wellbore services manifold system, and providing pressurized fluid from the pump to the wellbore services manifold system.

* * * * *